US007404308B2

(12) United States Patent
Zepp et al.

(10) Patent No.: US 7,404,308 B2
(45) Date of Patent: Jul. 29, 2008

(54) APPARATUS FOR PRODUCING HELICALLY CORRUGATED METAL PIPE AND RELATED METHOD

(75) Inventors: William L. Zepp, Maineville, OH (US); James C. Schluter, Franklin, OH (US)

(73) Assignee: Contech Construction Products Inc., West Chester, OH (US)

( * ) Notice: Subject to any disclaimer, the term of this patent is extended or adjusted under 35 U.S.C. 154(b) by 0 days.

(21) Appl. No.: 11/526,387

(22) Filed: Sep. 25, 2006

(65) Prior Publication Data

US 2008/0072642 A1 Mar. 27, 2008

(51) Int. Cl.
*B21C 37/12* (2006.01)

(52) U.S. Cl. ..... 72/49; 72/50; 72/180

(58) Field of Classification Search ..... 72/379.6, 72/49, 50, 51, 52, 370.19, 180, 385
See application file for complete search history.

(56) References Cited

U.S. PATENT DOCUMENTS

| | | | | |
|---|---|---|---|---|
| 1,056,962 | A * | 3/1913 | White | 72/180 |
| 3,183,695 | A * | 5/1965 | Darner | 72/49 |
| 3,247,692 | A | 4/1966 | Davis | |
| 3,263,321 | A * | 8/1966 | Lombardi | 29/429 |
| 3,474,514 | A * | 10/1969 | Lombardi | 72/50 |
| 3,566,643 | A * | 3/1971 | Westerbarkey | 72/49 |
| 3,604,464 | A * | 9/1971 | Pelley et al. | 138/154 |
| 3,857,159 | A * | 12/1974 | Davis | 29/429 |
| 4,244,202 | A * | 1/1981 | Anderson et al. | 72/49 |
| 4,791,800 | A | 12/1988 | Alexander | |

FOREIGN PATENT DOCUMENTS

JP 60257931 A * 12/1985

* cited by examiner

*Primary Examiner*—Dmitry Suhol
(74) *Attorney, Agent, or Firm*—Thompson Hine LLP

(57) ABSTRACT

A pipe manufacturing system and method for producing helically corrugated metal pipe is provided. The system and method utilize controlled profile formation.

8 Claims, 7 Drawing Sheets

APPARATUS FOR PRODUCING HELICALLY CORRUGATED METAL PIPE AND RELATED METHOD

TECHNICAL FIELD

This application relates generally to helically corrugated metal pipe commonly used in drainage applications and, more specifically, to an apparatus for effectively producing such pipe utilizing polymer coated steel.

BACKGROUND

The standard production process for producing helically corrugated metal pipe is well known and involves first forming lengthwise corrugations in an elongated strip of sheet metal, with the corrugations extending along the length of the strip. The corrugated strip is then spiraled into a helical form so that opposite edges of the corrugated strip come together and can be either crimped (commonly referred to as lock seaming) or welded to form a helical lock along the pipe.

U.S. Pat. No. 4,791,800 to Alexander describes a roll forming process for making box-shaped ribs in a sheet material, such as steel, utilizing a series of tooling stands through which the sheet material is moved. The system of U.S. Pat. No. 4,791,800 typically includes additional tooling stands to further flatten the curved areas of the strip (shown in FIG. 4 of U.S. Pat. No. 4,791,800) and to form edges for lock seaming.

SUMMARY

A system and method for producing helically corrugated metal pipe is provided using progressive profile formation that is more suited to producing a higher quality pipe product.

DETAILED DESCRIPTION

Figure 1:
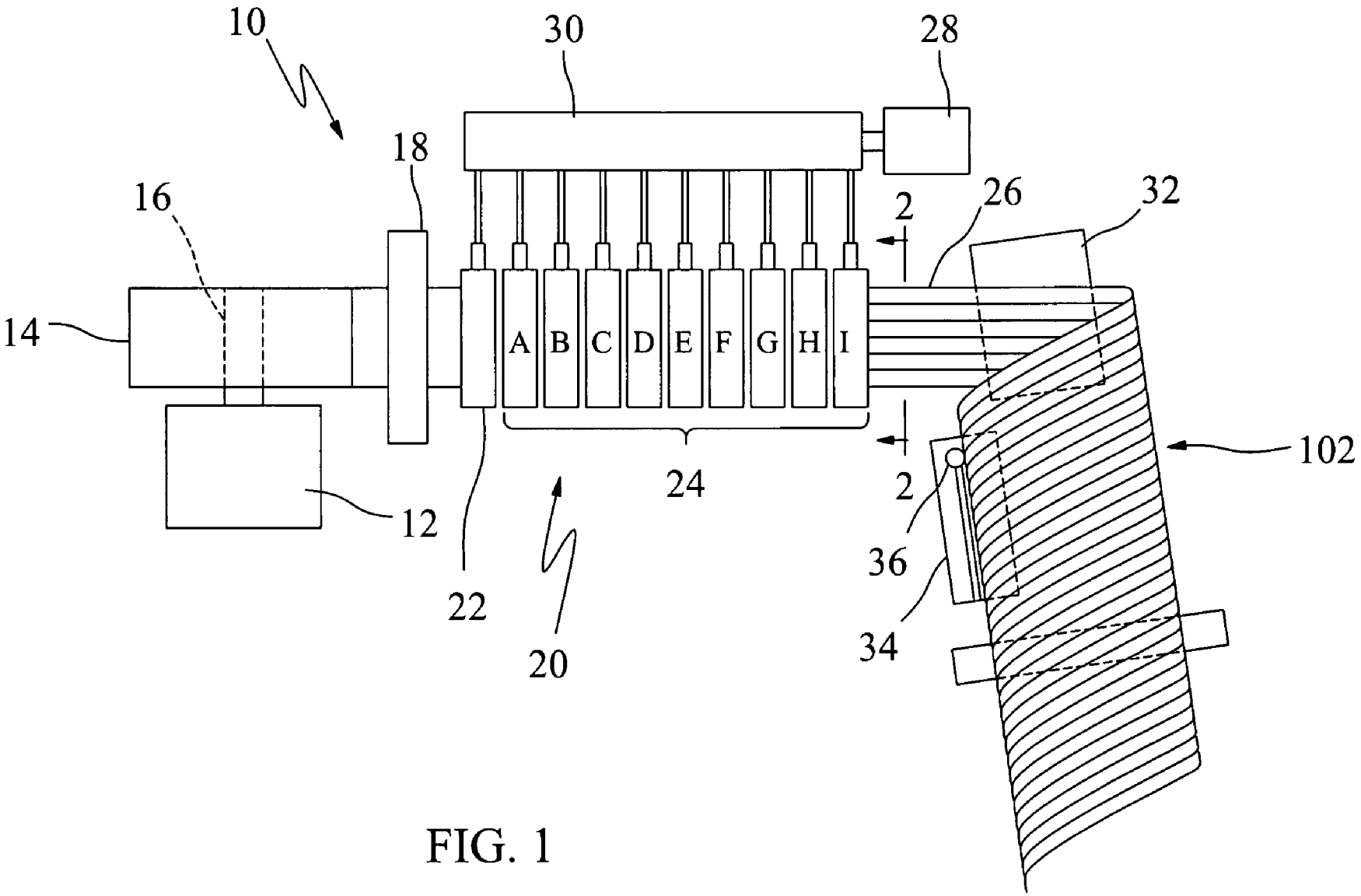
FIG. 1 is a top plan schematic of a pipe manufacturing device.
Figure 2:
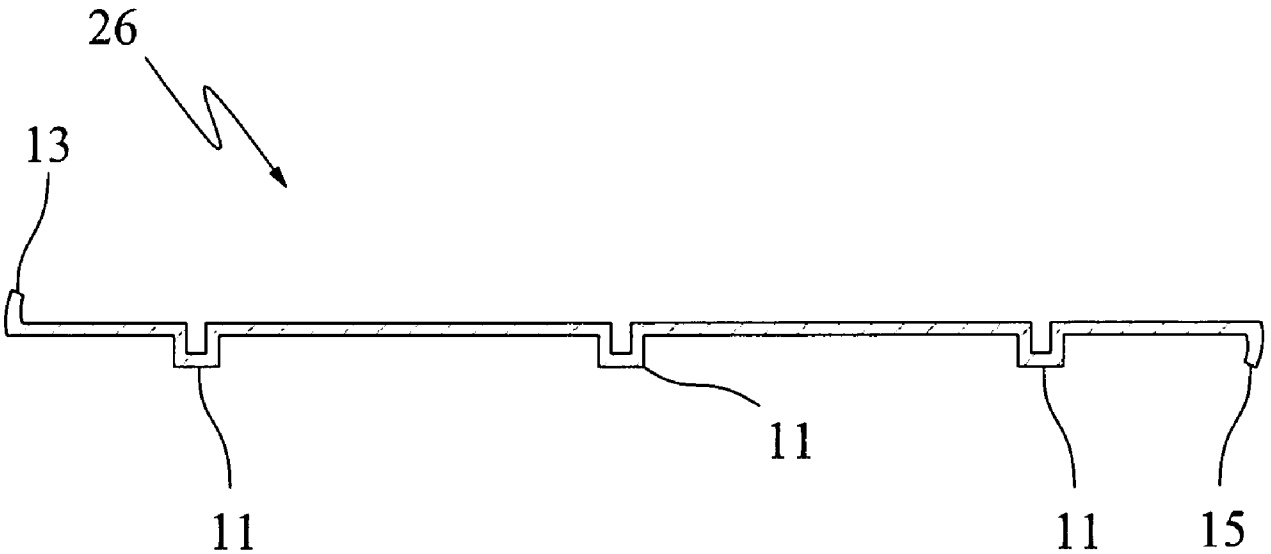
FIG. 2 is a cross-section of an exemplary corrugated metal strip taken along line 2-2 of FIG. 1.

Referring to FIG. 1, a pipe manufacturing line or device 10 is shown in top plan schematic form. The device 10 includes a decoiler unit 12 for receiving a coil 14 formed by a rolled metal sheet (which may or may not include a galvanized coating or a polymeric coating). The illustrated decoiler unit 12 supports the coil 14 on a rotatable expansion mandrel 16, permitting the coil to rotate during pipe manufacture. A weld table 18 is shown downstream of the decoiler unit 12 and is provided for welding the end of one metal sheet to the end of the metal sheet of a different coil upon coil replacement. A corrugating line 20 includes a pinch roll 22 for drawing the metal sheet off of the coil 14 and feeding the sheet through a number of tooling stands 24 (A thru I) that form box-shaped corrugations in the metal sheet to produce a corrugated metal strip 26. As will be described in greater detail below, the metal sheet passes between upper and lower tooling structure in each of the stands 24 to form corrugations. In one embodiment, the pipe manufacturing device operates to produce hydraulically efficient pipe such as that described in U.S. Pat. No. 4,838,317, in which case the corrugated metal strip may have a cross-section similar to that generally shown in FIG. 2, where the corrugations 11 are shown with a generally rectangular or box-shape and the side edges of the corrugated metal strip 26 include respective lips 13 and 15 for use in producing the helical lockseam described below. The exact configuration of locking lips 13 and 15 can vary.

Figure 3:
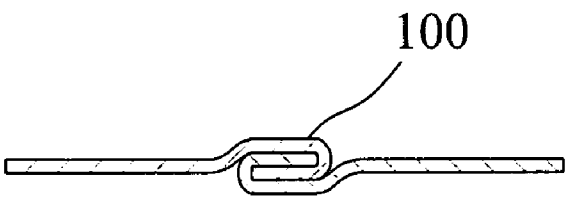
FIG. 3 is an exemplary cross-section of a lockseam.

The rotational tooling of the illustrated tooling stands may be driven by an electric motor 28 with its output linked to a gearbox/transmission arrangement 30. Multiple motors and gearboxes could also be provided. A forming head 32 is positioned to receive the corrugated metal strip 26 and includes a lockseam forming mechanism (not shown). The forming head 32 may be a well known three-roll forming head configured to spiral the corrugated metal strip 26 back upon itself as shown. The lockseam mechanism locks adjacent edges of the spiraled corrugated metal strip in a crimped manner to produce a helical lockseam 100 in the resulting pipe 102. Specifically, as the corrugated metal strip is helically curved back upon itself to form the pipe-shape, the locking lips 13 and 15 come together before passing into the lockseam mechanism, and the lockseam mechanism presses the lips together to produce a lockseam that may, in one example, have the general appearance of that shown in the cross-section of FIG. 3. In an alternative embodiment a weld arrangement could be provided to weld together the adjacent edges of the corrugated metal strip when they come together during spiraling.

Referring back to FIG. 1, a saw unit 34 is positioned along the pipe exit path and includes a saw 36 that is movable into and out of engagement with the pipe 102 and that is also movable along a path parallel to the pipe exit path so that the pipe can be cut even while pipe continues to be produced. Pipes with a variety of diameters can be formed by the device 10, and large scale diameter control is made by adjusting an entry angle of the corrugated metal strip 24 to the forming head 32. Such angle adjustment can be achieved by either by rotating the forming head 32 relative to a stationary corrugation line 20 or by rotating the corrugation line 20, weld table 18 and decoiler unit 12 relative to a stationary forming head 32.

Referring now to FIGS. 4A-4I, the configuration of the tooling of stands 24 is described along with the progressive profile each stand produces in the metal sheet.

Figure 4A:
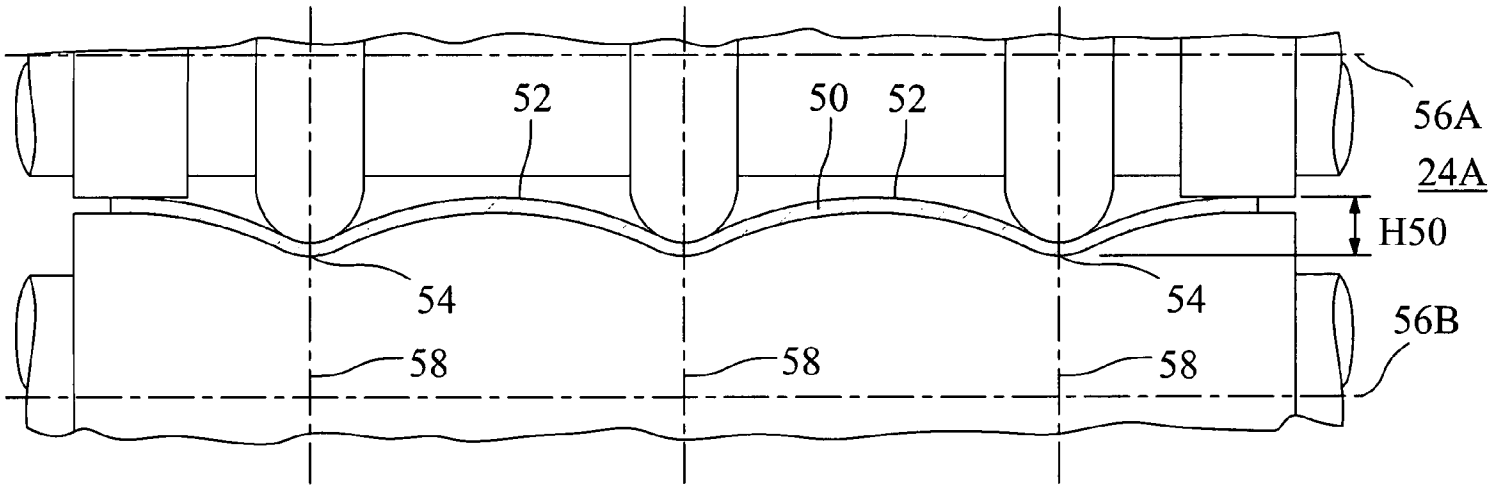
FIGS. 4A-4I depict embodiments of the tooling stands that form the corrugated metal strip.

FIG. 4A reflects tooling stand 24A, which receives the flat metal sheet from drive stand 22 and modifies the flat profile to produce the wave-shaped cross-sectional profile 50 (shown in cross-section) in the sheet, where upper 52 and lower 54 crests of the wave-shaped cross-sectional profile 50 are generally curved and lack any flats or small radius bends. As used herein, the term "small radius bends" means a bend having a radius that less than three times the thickness of the metal sheet that is being corrugated. Axes of rotation for the upper and lower tooling are shown respectively at 56A and 56B. Center lines of the lower crests of the profile are shown at 58.

Figure 4B:
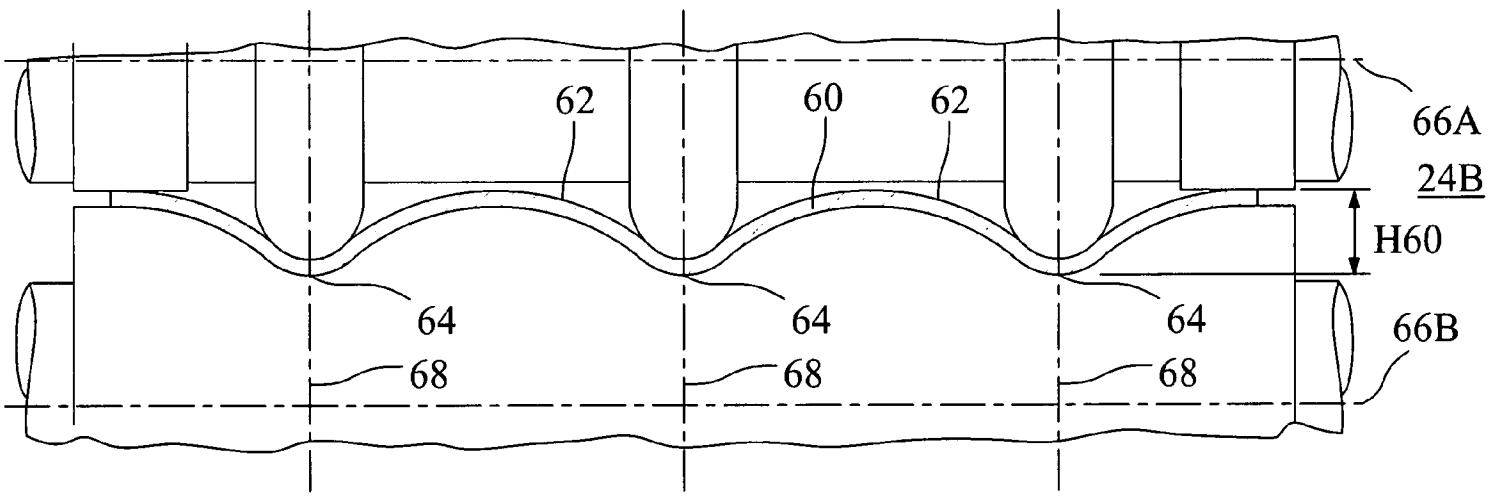

FIG. 4B reflects tooling stand 24B, which receives the profile 50 and modifies it to produce a wave-shaped cross-sectional profile 60, where upper 62 and lower 64 crests of the cross-sectional profile 60 are generally curved and lack any flats or small radius bends. A height H60 of the wave-shaped cross-sectional profile 60 is greater than a height H50 of the wave-shaped cross-sectional profile 50. As used herein the "height" of each cross-sectional profile is determined by the vertical distance between the top of an upper crest and the bottom of a lower crest. Axes of rotation for the upper and lower tooling are shown respectively at 66A and 66B. Center lines of the lower crests of the profile are shown at 68.

Figure 4C:
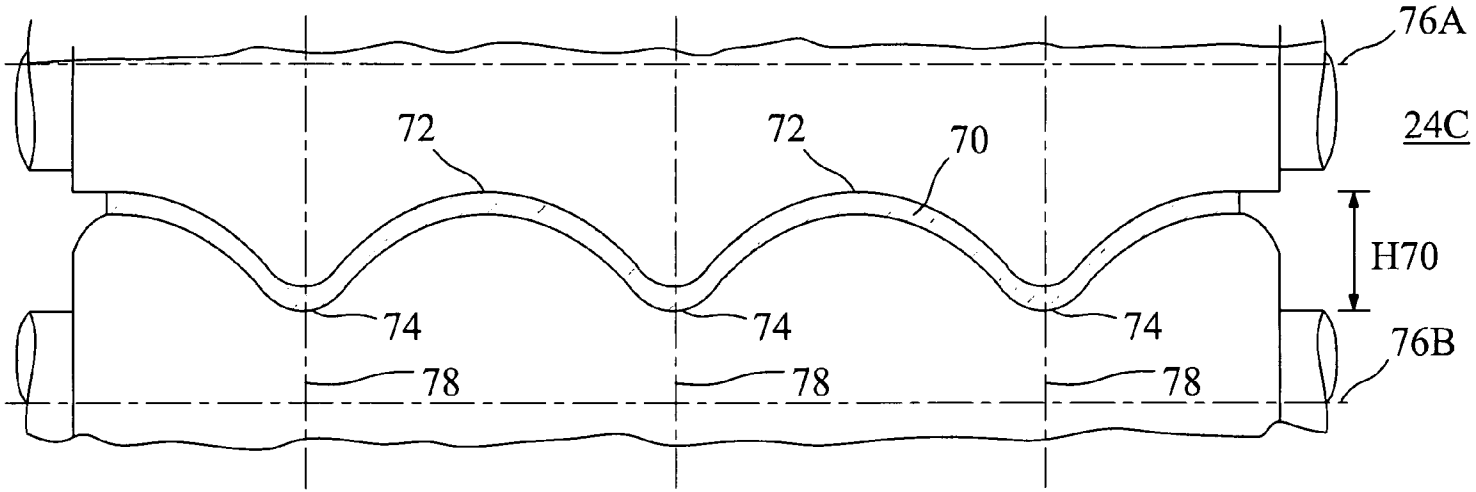

FIG. 4C reflects tooling stand 24C, which receives the profile 60 and modifies to produce a wave-shaped cross-sectional profile 70, where upper 72 and lower 74 crests of the wave-shaped cross-sectional profile 70 are generally curved and lack any flats or small radius bends. A height H70 of the wave-shaped cross-sectional profile 70 is greater than the height H60 of the wave-shaped cross-sectional profile 60. Axes of rotation for the upper and lower tooling are shown respectively at 76A and 76B. Center lines of the lower crests of the profile are shown at 78.

Figure 4D:
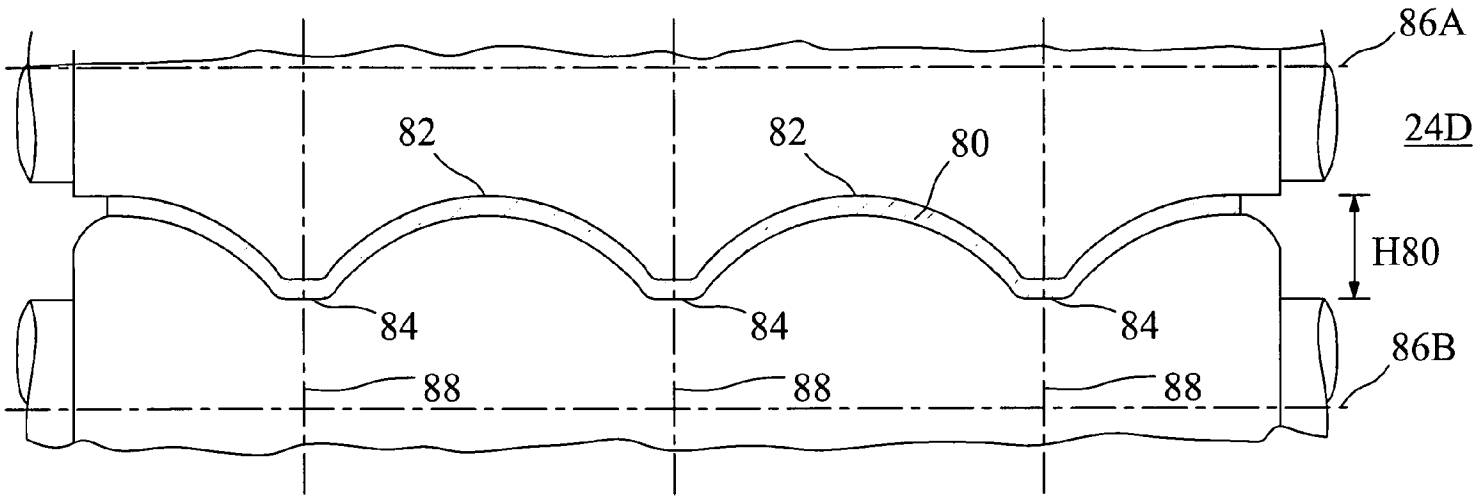

FIG. 4D reflects tooling stand 24D, which receives the profile 70 and modifies it so as to produce a wave-shaped cross-sectional profile 80 having upper crests 82 that are generally curved and lower crests 84 that are generally flat. A height H80 of the wave-shaped cross-sectional profile 80 is less than the height H70 of the wave-shaped cross-sectional profile 70. Axes of rotation for the upper and lower tooling are shown respectively at 86A and 86B. Center lines of the lower crests of the profile are shown at 88.

Figure 4E:
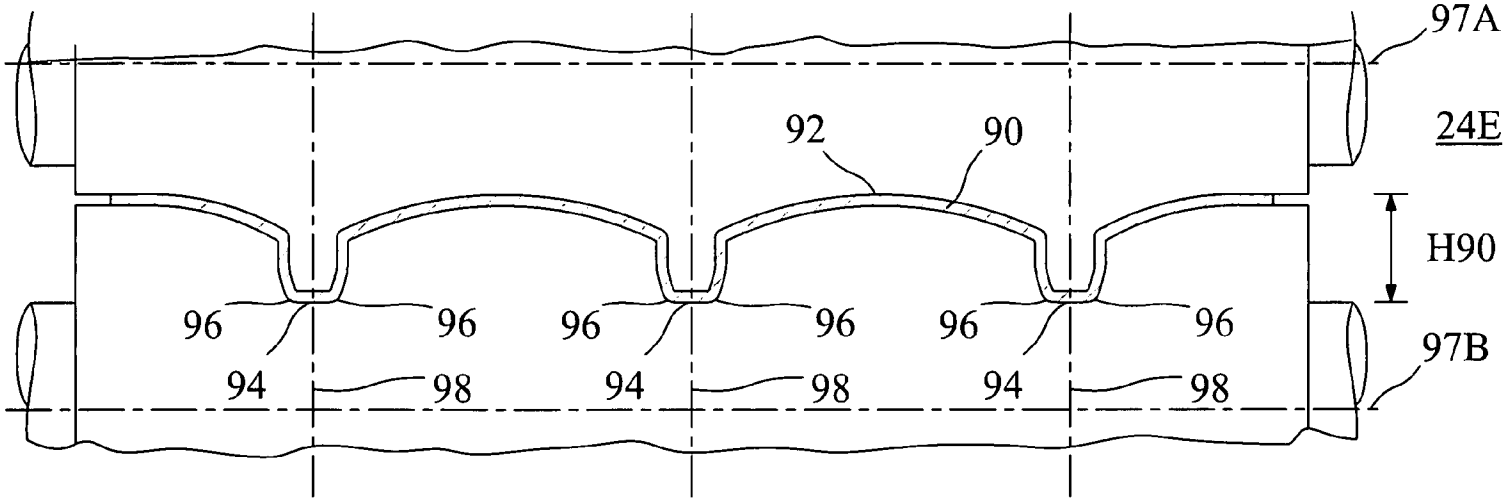

FIG. 4E reflects tooling stand 24E, which receives the profile 80 and modifies it so as to produce a wave-shaped cross-sectional profile 90 having upper crests 92 that are generally curved and lower crests 94 that are generally flat with small radius corners 96 at edges thereof. A height H90 of the wave-shaped cross-sectional profile 90 is less than the height H80 of the wave-shaped cross-sectional profile 80. Axes of rotation for the upper and lower tooling are shown respectively at 97A and 97B. Center lines of the lower crests of the profile are shown at 98.

Figure 4F:
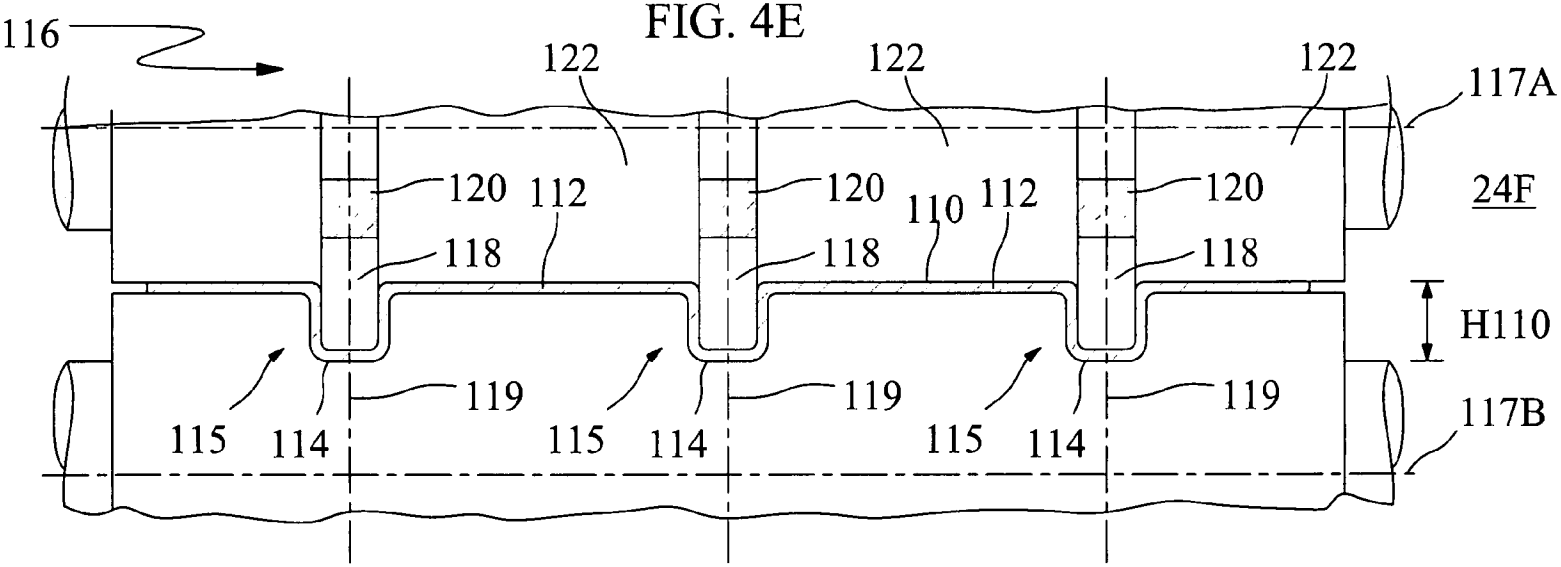
Figure 5:
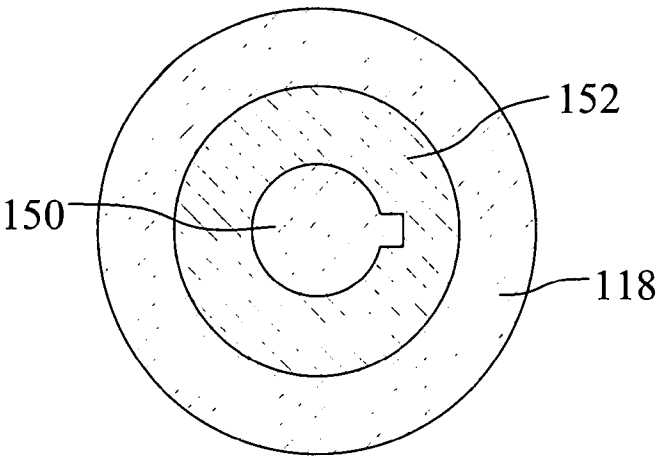
FIG. 5 depicts a tooling cross-section showing a slip-clutch arrangement.

FIG. 4F reflects tooling stand 24F, which receives the profile 90 and modifies it so as to produce a wave-shaped cross-sectional profile 110 having upper crests 112 that are generally flat and lower crests 113 that are generally flat with small radius corners. A height H110 of the wave-shaped cross-sectional profile 110 is less than the height H90 of the wave-shaped cross-sectional profile 90. At this point the formation of the box corrugations 115 is completed, and the remaining tooling stands simply modify the sheet edges to facilitate later formation of the lockseam as described above. Notably, the upper assembly 116 of tooling stand 24F is formed in a manner such that portions 118 that ride within the box-shaped corrugations 115 are driven by a slip-clutch arrangement (depicted by dashed area 120) with respect to the portions 122 of the assembly 116 that engage the upper crests 112. Referring to the partial cross-section of FIG. 5, the slip clutch arrangement may be achieved using a drive shaft 150 that is keyed to move an annular segment 152. Engagement between the outer surface of segment 152 and the inner surface of portion 118 causes the rotation of portion 118. This arrangement permits relative movement between the portions 118 and the segments 152, and thus tooling portions 122, when the frictional force between the two surfaces is overcome, thereby reducing the sliding of the portions 118 relative to the box-shaped corrugations 115. This feature is particularly advantageous for working polymer coated metal sheet as it reduces tearing of the polymer that can occur during sliding of portions 118 relative to the polymer. Axes of rotation for the upper and lower tooling are shown respectively at 117A and 117B. Center lines of the lower crests of the profile are shown at 119.

Figure 4G:
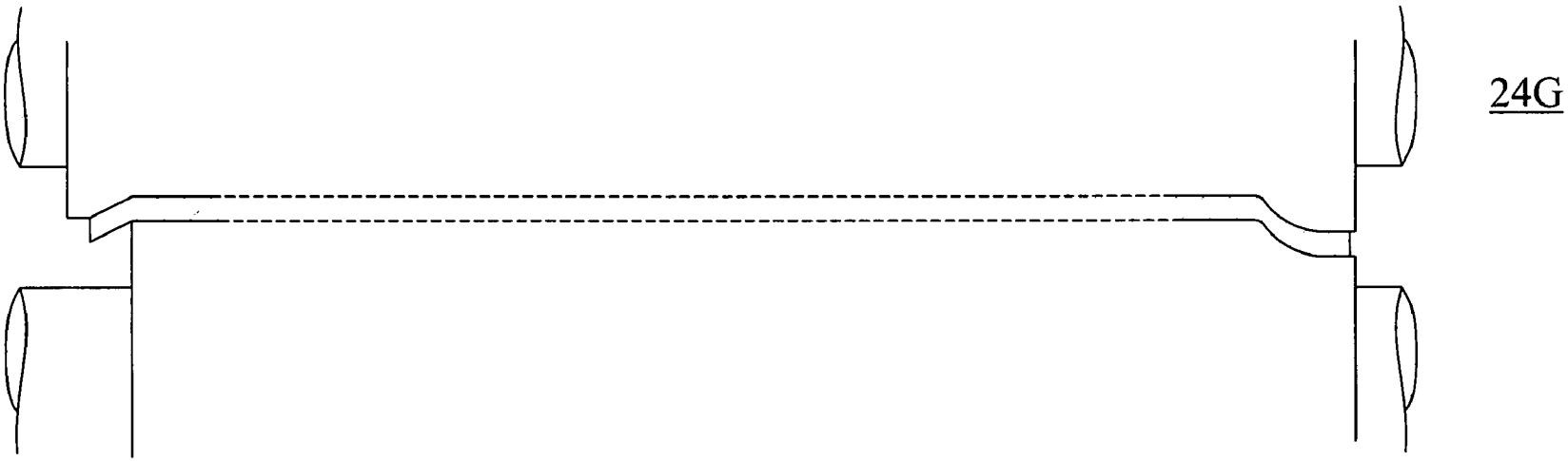
Figure 4H:
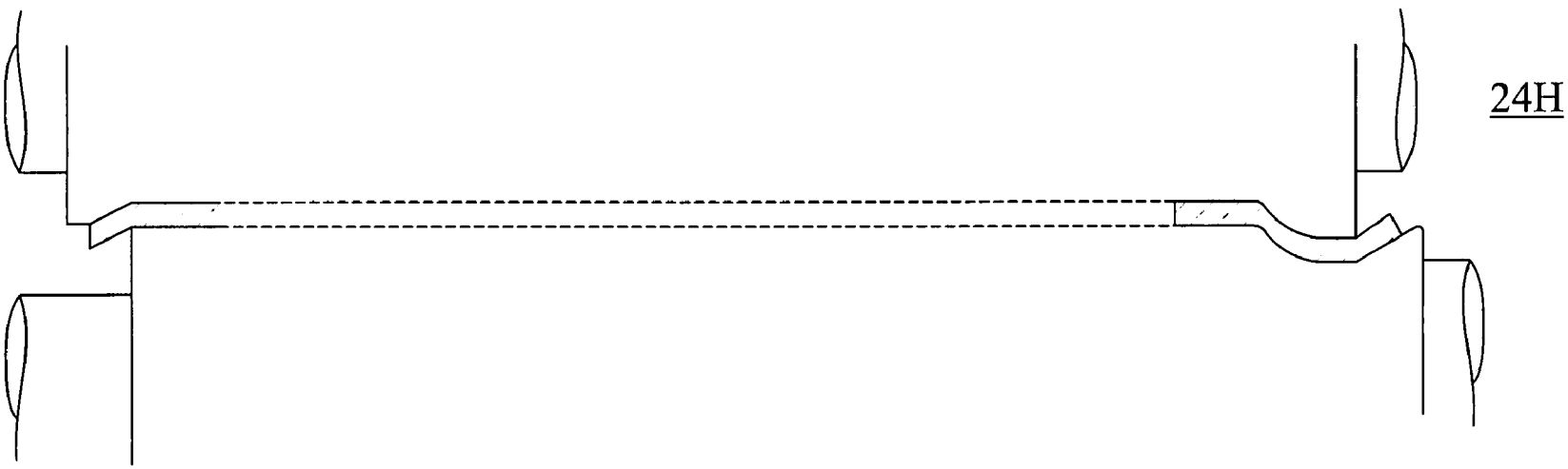
Figure 4I:
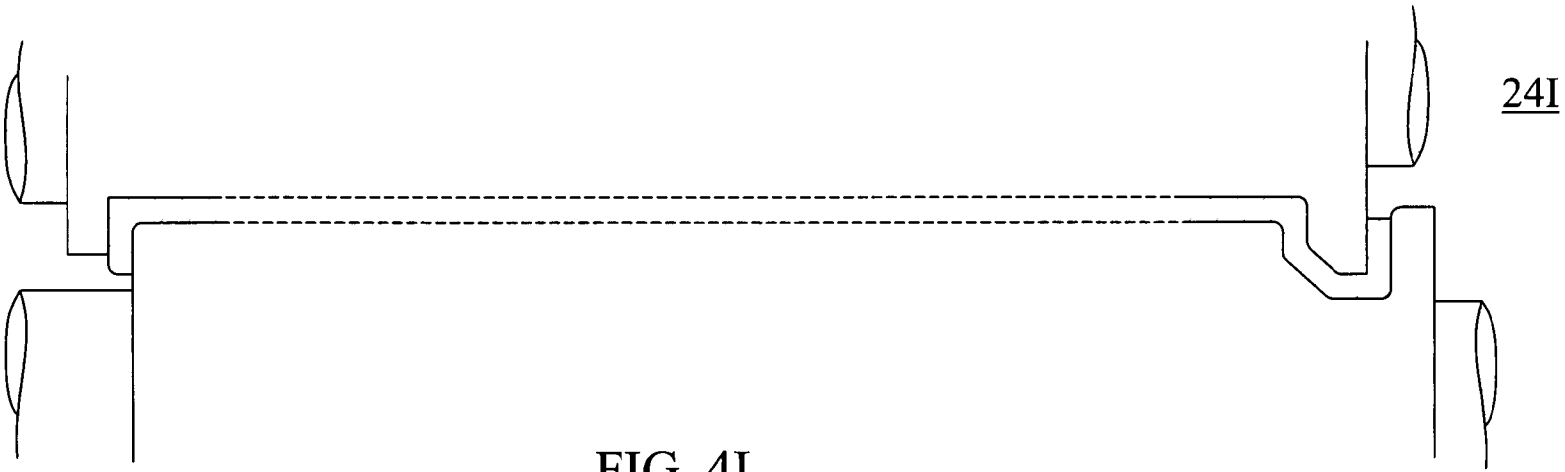

Referring to FIGS. 4G, 4H and 4I, it is noted that the central portion of each depicted tooling stand 24G, 24H and 24I is identical to that of stand 24F, inclusive of the described slip clutch driving of portions 118. Accordingly, in FIGS. 4*g*, 4H and 4I only the end portions of the stands are shown to depict the sheet edge modification for lockseaming.

Referring back to FIGS. 4A and 4B, the distance between center lines 58 in profile 50 may be slightly larger than the distance between center lines 68 in profile 60. In one embodiment, the distance between centerlines 68 in profile 60 is the same as the distance between centerlines 78, 88, 98 and 119 in respective profiles 70, 80, 90 and 110.

By utilizing initial tooling stands that gather the metal more slowly than that of the prior art, and that do not immediately attempt to form flats and corresponding small radius bends, the integrity of the metal sheet and any coating (polymer or otherwise) thereon is better maintained, producing a better quality end product. In the past, it has not been commercially viable to form helical pipe of the type described using polymer coated gauges of 14 or higher due to the resulting polymer damage and the labor involved in repairing such damage. Using the tooling system and method described above, such polymer damage can be significantly reduced, making the production of 14, 12 and even 10 gauge helically corrugated polymer coated metal pipe commercially viable. It may be possible to achieve a surface area polymer defect rate that is less than about 2% of total polymer surface area.

It is to be clearly understood that the above description is intended by way of illustration and example only and is not intended to be taken by way of limitation, and that changes and modifications are possible. Accordingly, other embodiments are contemplated.

What is claimed:

1. A pipe manufacturing apparatus, comprising:

(a) a decoiler unit for receiving a coil formed by a rolled metal sheet, the decoiler unit permitting the coil to rotate;

(b) a corrugating line for drawing the metal sheet off of the coil and placing corrugations in the metal sheet to produce a corrugated metal strip, the corrugating line comprising:

(i) a first tooling stand configured to receive flat sheet material and to produce a first wave-shaped cross-sectional profile in the sheet, where upper and lower crests of the first wave-shaped cross-sectional profile are generally curved and lack any flats or small radius bends;

(ii) a second tooling stand downstream of the first tooling stand and configured to modify the first wave-shaped cross-sectional profile so as to produce a second wave-shaped cross-sectional profile, where upper and lower crests of the second wave-shaped cross-sectional profile are generally curved and lack any flats or small radius bends, and a height of the second wave-shaped cross-sectional profile is greater than a height of the first wave-shaped cross-sectional profile; and (iii) multiple tooling stands downstream of the second tooling stand for completing formation of multiple box-shaped corrugations in the metal sheet to form a corrugated metal strip in which the spacing between box-shaped corrugations along the width of the strip is substantially greater than the box-shaped corrugation width, each box-shaped corrugation including a generally flat bottom portion and upwardly extending parallel side portions;

(c) a forming head positioned to receive the corrugated metal strip and to spiral the corrugated metal strip into a pipe-shape.

2. The pipe manufacturing apparatus of claim 1 wherein the corrugating line further includes a drive stand formed by opposed pinch rollers, the drive stand located upstream of the first tooling stand.

3. A pipe manufacturing apparatus, comprising:

(a) a decoiler unit for receiving a coil formed by a rolled metal sheet, the decoiler unit permitting the coil to rotate;

(b) a corrugating line for drawing the metal sheet off of the coil and placing corrugations in the metal sheet to produce a corrugated metal strip, the corrugating line comprising:

(i) a first tooling stand configured to receive flat sheet material and to produce a first wave-shaped cross-sectional profile in the sheet, where upper and lower crests of the first wave-shaped cross-sectional profile are generally curved and lack any flats or small radius bends;

(ii) a second tooling stand downstream of the first tooling stand and configured to modify the first wave-shaped cross-sectional profile so as to produce a second wave-shaped cross-sectional profile, where upper and lower crests of the second wave-shaped cross-sectional profile are generally curved and lack any flats or small radius bends, and a height of the second wave-shaped cross-sectional profile is greater than a height of the first wave-shaped cross-sectional profile;

(iii) multiple tooling stands downstream of the second tooling stand for completing formation of multiple box-shaped corrugations in the metal sheet to form a corrugated metal strip, the multiple tooling stands including:

(1) a third tooling stand downstream of the second tooling stand and configured to modify the second wave-shaped cross-sectional profile so as to produce a third wave-shaped cross-sectional profile, upper and lower crests of the third wave-shaped cross-sectional profile are generally curved and lack any flats or small radius bends, a height of the third wave-shaped cross-sectional profile is greater than the height of the second wave-shaped cross-sectional profile; and (2) a fourth tooling stand downstream of the third tooling stand and configured to modify the third wave-shaped cross-sectional profile so as to produce a fourth wave-shaped cross-sectional profile having upper crests that are generally curved and lower crests that are generally flat, a height of the fourth wave-shaped cross-sectional profile is less than the height of the third wave-shaped cross-sectional profile;

(iv) a drive stand formed by opposed pinch rollers, the drive stand located upstream of the first tooling stand; and (c) a forming head positioned to receive the corrugated metal strip and to spiral the corrugated metal strip into a pipe-shape.

4. The pipe manufacturing apparatus of claim 3 wherein the multiple tooling stands of (b)(iii) further include:

(4) a fifth tooling stand downstream of the fourth tooling stand and configured to modify the fourth wave-shaped cross-sectional profile so as to produce a fifth wave-shaped cross-sectional profile having upper crests that are generally curved and lower crests that are generally flat with small radius corners at edges thereof, a height of the fifth wave-shaped cross-sectional profile is less than the height of the fourth wave-shaped cross-sectional profile;

(5) a sixth tooling stand downstream of the fifth tooling stand and configured to modify the fifth wave-shaped cross-sectional profile so as to produce a sixth wave-shaped cross-sectional profile having upper crests that are generally flat and lower crests that are generally flat, a height of the sixth wave-shaped cross-sectional profile is less than the height of the fifth wave-shaped cross-sectional profile;

(6) one or more additional tooling stands for modifying side edges of the sheet to create lock seaming lips.

5. The pipe manufacturing apparatus of claim 4 wherein a distance between centers of the lower crests of the fourth wave-shaped cross-sectional profile is the same as both (i) a distance between centers of the lower crests of the fifth wave-shaped cross-sectional profile and (ii) a distance between centers of the lower crests of the sixth wave-shape cross-sectional profile.

6. The pipe manufacturing apparatus of claim 4 wherein the sixth wave-shaped cross-sectional profile includes box-shaped corrugations that form the lower crests, and the sixth tooling stand includes a rotating upper tooling assembly having first portions that ride within the box-shaped corrugations and second portions that engage the upper crests, the first portions are driven by a slip-clutch arrangement with respect to the second portions to permit relative movement between the first portions and the second portions so as to reduce sliding of the first portions relative to the box-shaped corrugations.

7. A pipe manufacturing apparatus, comprising:

(a) a decoiler unit for receiving a coil formed by a rolled metal sheet, the decoiler unit permitting the coil to rotate;

(b) a corrugating line for drawing the metal sheet off of the coil and placing corrugations in the metal sheet to produce a corrugated metal strip, the corrugating line comprising:

(i) at least one tooling stand that produces a flat-free wave-shaped cross-sectional profiles having respective upper and lower crests that are generally curved and lack any flats or small radius bends;

(ii) a first tooling stand downstream of the at least one tooling stand and configured to modify the flat-free wave-shaped cross-sectional profile so as to produce a first flat-inclusive wave-shaped cross-sectional profile having upper crests that are generally curved and lower crests that are generally flat;

(iii) a second tooling stand downstream of the first tooling stand and configured to modify the first flat-inclusive wave-shaped profile so as to produce a second flat-inclusive wave-shaped profile having upper crests that are generally curved and lower crests that are generally flat, where a height of the second flat-inclusive wave-shaped cross-sectional profile is less than a height of the first flat-inclusive wave-shaped cross-sectional profile, wherein a distance between centers of the lower crests of the second flat-inclusive wave-shaped cross-sectional profile is the same as a distance between centers of the lower crests of the first flat-inclusive wave-shaped cross-sectional profile;

(iv) at least one tooling stand downstream of the second tooling stand for completing formation of multiple box-shaped corrugations in the metal sheet to form a corrugated metal strip;

(c) a forming head positioned to receive the corrugated metal strip and to spiral the corrugated metal strip into a pipe-shape.

8. The pipe manufacturing apparatus of claim 7 wherein the at least one tooling stand downstream of the second tooling stand includes a tooling stand with a rotating upper tooling assembly having first portions that ride within the box-shaped corrugations and second portions that engage the upper crests, the first portions are driven by a slip-clutch arrangement with respect to the second portions to permit relative movement between the first portions and the second portions so as to reduce sliding of the first portions relative to the box-shaped corrugations.

* * * * *